United States Patent [19]

Fujimoto et al.

[11] Patent Number: 4,932,382

[45] Date of Patent: Jun. 12, 1990

[54] FUEL CONTROL SYSTEM

[75] Inventors: Takanori Fujimoto; Toshiro Hara, both of Himeji, Japan

[73] Assignee: Mitsubishi Denki Kabushiki Kaisha, Tokyo, Japan

[21] Appl. No.: 299,378

[22] Filed: Jan. 23, 1989

[30] Foreign Application Priority Data

Jan. 26, 1988 [JP] Japan ..... 63-16113
Jan. 26, 1988 [JP] Japan ..... 63-16114[U]
Jan. 26, 1988 [JP] Japan ..... 63-16115

[51] Int. Cl.[5] ..... F02D 41/18

[52] U.S. Cl. ..... 123/488; 73/861.22; 123/493; 123/494

[58] Field of Search ..... 123/488, 492, 493, 494; 73/861.22, 861.23

[56] References Cited

U.S. PATENT DOCUMENTS 3,818,877 6/1974 Barrera et al. ..... 123/494
3,864,972 2/1975 Burgess et al. ..... 73/861.22.

FOREIGN PATENT DOCUMENTS 15045 3/1983 Japan .
256819 10/1988 Japan ..... 73/861.22
256820 10/1988 Japan ..... 73/861.22
256821 10/1988 Japan ..... 73/861.22
256822 10/1988 Japan ..... 73/861.22
256823 10/1988 Japan ..... 73/861.22

*Primary Examiner*—Tony M. Argenbright
*Attorney, Agent, or Firm*—Sughrue, Mion, Zinn, Macpeak & Seas

[57] ABSTRACT

A fuel control system for an internal combustion engine for controlling fuel supply rate on the basis of the output signal of a vortex flowmeter having variable-frequency filter means, capable of accurately measuring intake air flow to control the fuel supply rate accurately avoiding the erroneous measurement of noises generated during the rapid deceleration of the engine in which the throttle valve is shut. The fuel supply system has operating mode detecting means for detecting the operating mode of the engine, and passband fixing means for fixing the passband of the variable-frequency filter means at a predetermined passband when the operating mode detecting means detects that the engine is in a predetermined deceleration mode. The passband of the variable-frequency filter means is fixed at the predetermined passband while the engine is in the predetermined deceleration mode to enable accurate control of fuel supply rate by eliminating noise signals which is generated during the predetermined deceleration mode and superposed on the operating mode detection signal. When the engine is accelerated during a time period subsequent to the end of the predetermined deceleration mode, the fixation of the passband of the variable-frequency filter means is cancelled.

8 Claims, 8 Drawing Sheets

FUEL CONTROL SYSTEM

BACKGROUND OF THE INVENTION

1. FIELD OF THE INVENTION

The present invention relates to a fuel control system for an internal combustion engine, which controls fuel supply rate on the basis of intake air flow detected by using a Karman vortex street.

2. DISCUSSION OF BACKGROUND

The conventional fuel control system for an internal combustion engine measures an intake air flow in a suction stroke with a vortex flowmeter which generates a signal of a frequency proportional to the intake air flow, obtains a fuel injector driving period by multiplying the measured intake air flow by a correction coefficient and adding a dead time calculated on the basis of the voltage of the battery, i.e., a power supply, to the product, and drives the fuel injectors for the injector driving period to control the fuel supply rate.

The prior art will be described with reference to FIG. 5 showing a vortex flowmeter applied to a fuel control system in accordance with the present invention.

An ultrasonic transmitter 4 and an ultrasonic receiver 5 are disposed opposite to each other with a flowmeter 1 having a vortex generator 2 therebetween. An ultrasonic oscillator 6 drives the ultrasonic transmitter 4 so that ultrasonic waves are propagated across a Karman vortex street 3 generated after the vortex generator 2.

The ultrasonic waves propagated across the Karman vortex street 3 undergo phase modulation and are received by the ultrasonic receiver 5. A waveform shaping circuit 8 shapes the waveform of the received signal and gives an output signal to a phase comparator 9.

On the other hand, the output of the ultrasonic oscillator 6 driving the ultrasonic transmitter 4 is applied to a voltage-controlled phase deviating circuit 7.

The voltage controlled phase shift circuit 7 maintains the high frequency stability of an ultrasonic oscillation frequency signal and controls only the phase shift. The voltage controlled phase shift circuit 7 applies the output of the ultrasonic oscillator 4 to the phase comparator 9 after shifting the phase of the same.

The phase comparator 9, the ultrasonic oscillator 6, the voltage-controlled phase shift circuit 7 and a loop filter 10 constitute a phasing loop. Indicated at 11 is a low pass filter.

The phase comparator 9 compares the phase of the output of the waveform shaping circuit 8 and the phase of the output of the voltage-controlled phase shift circuit 7, and then applies signal presenting the result of comparison to the loop filter 10. The loop filter 10 removes the unwanted frequency component of the result of comparison.

The voltage controlled phase shift circuit 7 controls the phase shift of the output signal of the ultrasonic oscillator 6 according to the output voltage of the loop filter 10, and then gives an output signal to the phase comparator 9.

The output of the phase comparator 9 is given directly to the loop filter 10, and through the low-pass filter 11 to a first variable-frequency filter 12.

The first variable-frequency filter 12 is high-pass filter which passes the high-frequency components of the output signal of the low-pass filter to a second variable-frequency filter 13.

The second variable-frequency filter 13 is a low-pass filter which passes the low-frequency components of the input signal to a waveform shaping circuit 14.

Referring to FIG. 6, the first variable-frequency filter 12, i.e., a high pass filter, removes noise components of frequencies below a lower limit frequency $f_L$. The second variable-frequency filter 13, i.e., a low-pass filter, removes engine noise components of frequencies above an upper limit frequency $f_U$. Consequently, a frequency band between the upper limit frequency $f_U$ and the lower limit frequency $f_L$ is a passband for both the first variable frequency filter 12 and the second variable-frequency filter 13.

The engine noise is a noise of a comparatively low frequency generated by the pulsation of air flow, a noise of a low output frequency resulting from a so-called swishy sound generated as air flows through an air valve, namely, a noise of a comparatively high frequency, or a noise of a high output frequency generated by the supercharger.

Since a noise generating region is variable and the air flow varies according to the momentarily variable operating mode of the engine, the frequencies of vortices are distributed in a comparatively wide band width. Accordingly, the first variable-frequency filter 12 and the second variable-frequency filter 13 are employed in combination.

A waveform shaping and amplifying circuit 14 shapes the waveform of a vortex frequency signal passed by the first variable-frequency filter 12 and the second variable-frequency filter 13 and amplifies the same to provide a vortex frequency signal.

At the same time, a frequency to-voltage converter (hereinafter, referred to as "f-V converter") 15 converts the vortex frequency signal into a voltage corresponding to the frequency. The respective passbands of the first variable-frequency filter 12 and the second variable-frequency filter 13 are controlled on the basis of the voltage provided by the f-V converter 15.

Thus, the respective passbands of the first variable-frequency filter 12 and the second variable-frequency filter 13 are varied, so that the width of the passband indicated by a hatched area in FIG. 6 is varied.

The conventional fuel control system for an engine thus constituted is unable to achieve accurate fuel control when applied to an engine equipped with a supercharger, because the waveform of a vortex signal is disturbed by ultrasonic noises generated by the supercharger in measuring intake air flow by the vortex flowmeter.

Particularly, when the throttle valve is shut suddenly, the intake air flow diminishes, whereas the rotating speed of the rotor of the supercharger does not drop rapidly due to the inertia of the rotor. Accordingly, the SN ratio of the waveform of a signal at the output terminal of the second variable frequency filter 13 is very low as against a signal at the input terminal of the first variable-frequency filter 12.

When a signal of such a waveform is applied to the second variable frequency filter 13, the variable-frequency filter 13 provides an output signal of a very high frequency. Consequently, during deceleration in which the throttle valve is shut, excessive fuel is supplied to the engine, and the overrich mixture deteriorates the operation of the engine during deceleration.

SUMMARY OF THE INVENTION

The present invention has been made to solve the foregoing problems in the conventional fuel control system.

Accordingly, it is an object of the present invention to provide a fuel control system for an internal combustion engine, capable of accurately measuring an intake air flow to control the fuel supply rate accurately avoiding the erroneous measurement of noises generated during the rapid deceleration of the engine in which the throttle valve is shut.

In one aspect of the present invention, a fuel control system for controlling fuel supply rate for an internal combustion engine on the basis of the output signal of a vortex flowmeter including signal detecting means for detecting a vortex signal corresponding to an intake air flow in the engine, and variable-frequency filter means which passes the output signal of the signal detecting means having variable frequency bands corresponding to the frequencies of the output signals of the signal detecting means to eliminate noise signals superposed on the vortex signal comprises operating mode detecting means for detecting the operating mode of the engine, and passband fixing means for fixing the passband of the variable-frequency filter means at a predetermined passband in accordance with the output signal of the operating mode detecting means.

In another aspect of the present invention, a fuel control system for controlling fuel supply rate for an internal combustion engine on the basis of the output signal of a vortex flowmeter including signal detecting means for detecting a vortex signal corresponding to an intake air flow in the engine, and variable-frequency filter means for passing the output signal of the signal detecting means in a passband corresponding to the frequency of a feedback signal comprises passband fixing means for fixing the passband of the variable-frequency filter means at a predetermined passband during a predetermined deceleration mode in which the decrement of the opening of the throttle valve is not less than a predetermined value and during a predetermined time interval subsequent to the predetermined deceleration mode.

BRIEF DESCRIPTION OF THE DRAWINGS

The above and other objects, features and advantages of the present invention will become more apparent from the following description taken in conjunction with the accompanying drawings in which.

DETAILED DESCRIPTION OF THE PREFERRED EMBODIMENTS

Preferred embodiment of the present invention will be described with reference to the drawings.

Figure 1:
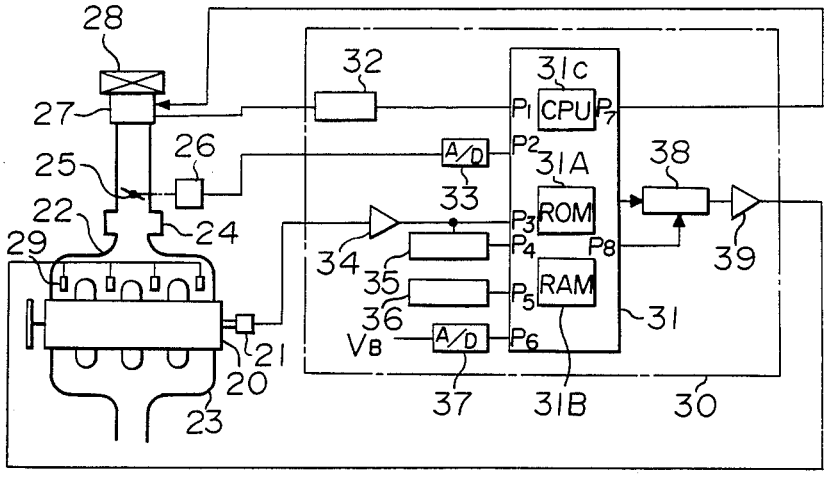
FIG. 1 is a block diagram showing the general constitution of a fuel control system in a first embodiment according to the present invention.

Shown in FIG. 1 are a well-known engine 20 mounted on, for example, a vehicle, a crank angle sensor 21 which generates pulses, for example, every rotation of the crankshaft of the engine 20 through 180°, an intake manifold 22, an exhaust manifold 23, a surge tank 24 disposed on the upstream side of the intake manifold 22 to absorb sudden rise of pressure in the suction pipe, a throttle valve 25 provided in the suction pipe on the upstream side of the surge tank 24, a throttle position sensor 26 which generates an analog signal corresponding to the position of the throttle valve 25, an AFS 27, i.e., a vortex flowmeter, provided in the suction pipe on the upstream side of the throttle valve 25, which generates a signal of a frequency corresponding to an intake air flow, and an air cleaner 28 provided at the inlet of the suction pipe.

A control unit 30 controls fuel injectors 29, for example, four fuel injectors, provided respectively for the cylinders of the engine 20 on the basis of output signals of the crank angle sensor 21, the throttle position sensor 26 and the AFS 27 given thereto.

Figure 2:
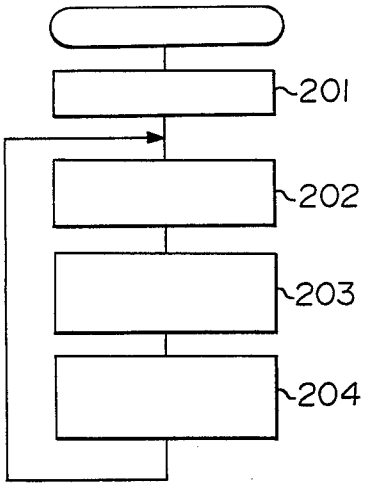
FIG. 2, 3 and 4 are flow charts of assistance in explaining the operation of a microcomputer incorporated into the fuel control system of FIG. 1.
Figure 3:
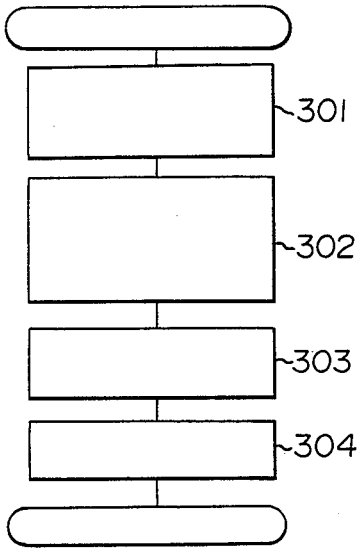
Figure 4:
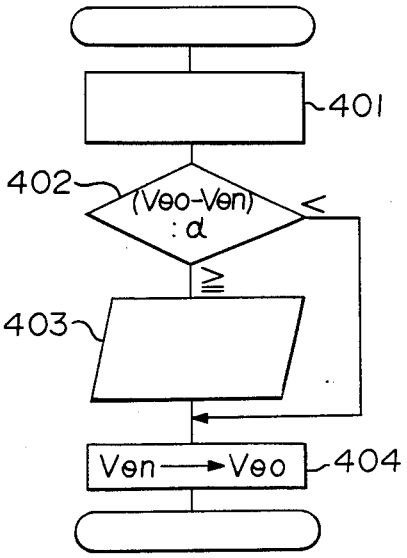

The control unit 30 comprises: a microcomputer 31 internally having a ROM 31A storing programs represented by flow charts shown in FIGS. 2,3 and 4, a RAM 31B serving as a work area, and a CPU 31; an interface 32 connected to the output terminal of the AFS 27 and an input terminal $P_1$ of the microcomputer 31 to transfer the output signal of the AFS 27 to the microcomputer 31; an AD converter (analog-to-digital converter) 33 connected to the throttle position sensor 26 and an input terminal $P_2$ of the microcomputer 31; a waveform shaping circuit 34 connectd to the crank angle sensor 21, an interrupt input terminal $P_3$ of the microcomputer 31 and a counter 35 connected to an input terminal $P_4$ of the microcomputer 31; a timer 36 connected to an interrupt input terminal $P_5$ of the microcomputer 31; an AC converter 37 for converting the voltage of a battery, not shown, into a corresponding digital voltage signal and applying the digital voltage signal to an input terminal $P_6$ of the microcomputer 31; a driver 39 connected to the fuel injectors 29; and a timer 38 connected to the microcomputer 31 and the driver 39.

The constitution of the AFS 27 will be described hereinafter with reference to FIG. 5, in which the description of those described in relation to the prior art will be omitted to avoid duplication.

Figure 5:
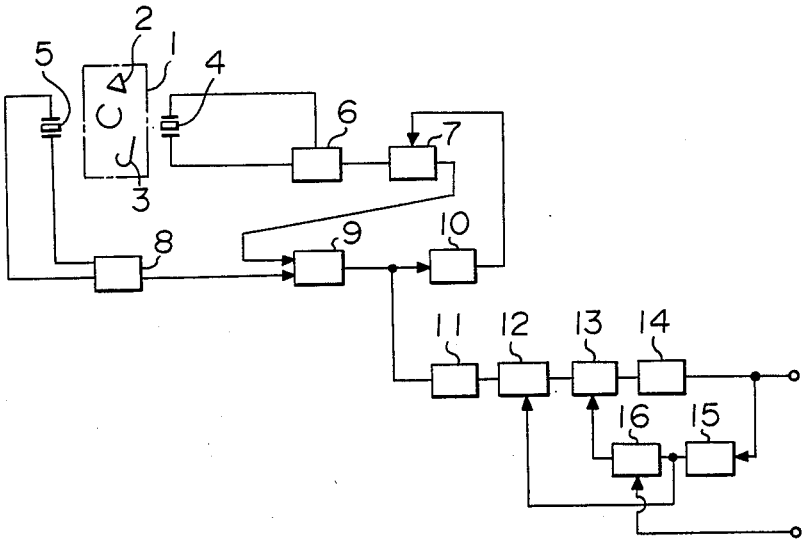
FIG. 5 is a block diagram of an air flow sensor (hereinafter, abbreviated to "AFS") incorporated into the fuel control system of FIG. 1.

In FIG. 5, parts denoted by reference numerals 1 to 15 are the same as those of the AFS of the conventional fuel control system. The AFS 27 in accordance with the present invention is additionally provided with a gate circuit 16. An output voltage of the F-V converter 15 is applied throught the first variable-frequency filter 12 and the gate circuit 16 to the second variable-frequency filter 13. The microcomputer 31 (FIG. 1) gives a passband fixing control signal to the gate circuit 16.

Upon the detection of a decelerating operation of the engine on the basis of a position of the throttle valve 25 detected by the throttle position sensor 26, the microcomputer 31 gives the passband fixing control signal to the gate circuit 16 to fix the passband of the second variable-frequency filter 13 at a predetermined passband.

The operation of the fuel control system will be described hereinafter. The engine 20 sucks combustion air through the air cleaner 28, the AFS 27, the throttle valve 25, the surge tank 24 and the intake manifold 22. The control unit 30 provides fuel injector control signals to control the operation of the fuel injectors 29 to inject fuel into the cylinders of the engine 20. The exhaust gas is discharged through the exhaust manifold 23.

The frequency of an output of the AFS 27 measured by the interface 32 is give to the microcomputer 31. The throttle position sensor 26 gives a throttle position signal representing a position of the throttle valve 25 to the AD converter 33. The AD converter 33 converts the throttle position signal into a corresponding digital throttle position signal and gives the same to the microcomputer 31. The microcomputer 31 decides on the basis of the digital throttle position signal whether or not the variation of throttle position in a detection cycle is greater than a predetermined value, and then provides a control signal corresponding to the results of decision through an output terminal $P_7$ to control the passband of the signal of the AFS 27. The output signal of the crank angle sensor 21 is applied through the waveform shaping circuit 34 to the interrupt input terminal $P_3$ of the microcomputer 31 and the counter 35. Then, the microcomputer 31 executes an interruption subroutine at every leading edge of output pulses of the crank angle sensor 21 to detect the period of the output pulses of the crank angle sensor 21 from the output of the counter 35. The timer 36 applies an interrupt request signal to the interrupt input terminal $P_5$ of the microcomputer 31 every predetermined time. The AD converter 37 converts the output voltage $V_B$ of a battery, not shown, into a digital voltage signal VB. The microcomputer 31 reads the output digital voltage signal VB of the AD converter 37 periodically. The timer 38 is preset by the microcomputer 31 and is triggered by a trigger signal applied thereto by the microcomputer through an output terminal $P_8$. Output signals of the timer 38 are applied to the driver 39 to drive the fuel injectors 29.

The operation of the microcomputer 31 will be described further with reference to FIGS. 2, 3 and 4.

Referring to FIG. 2 showing a main routine to be executed by the microcomputer 31, a reset signal is given to the microcomputer 31 in Step 201 to initialize the RAM 31B and the input and output ports of the microcomputer 31. The digital voltage signal VB corresponding to the output voltage $V_B$ of the battery is stored in the RAM 31B in Step 202. Then, in Step 203, a dead time $T_D$ corresponding to the digital voltage signal VB is obtained by mapping a data table $f_1$ stored in the ROM 31A and the dead time $T_D$ is stored in the RAM 31B. Then, in Step 204, the temperature of the engine cooling water is detected by a temperature sensor, not shown, for detecting the temperature of the engine cooling water, a correction coefficient $K_C$ for correcting the fuel supply rate according to the temperature of the cooling water and the correction coefficient $K_C$ is stored in the RAM 31B. Then the routine returns to Step 202 to repeat the foregoing Steps of control operation.

Referring to FIG. 3 showing an interrupt subroutine to be excecuted when an interrupt request signal is applied to the interrupt input terminal $P_3$ of the microcomputer 31 at the leading edge of a pulse generated by the crank angle sensor 21, a unit intake air flow AN, namely, an intake air flow for each operating cycle of the engine 20 (load data) is calculated in Step 301 on the basis of data obtained by periodically measuring output signals of the AFS 27 by the interface 32 and a measured period of rotation of the crankshaft of the engine 20 measured by the counter 35. The correction coefficient $K_C$ and the dead time $T_D$ is read from the RAM 31B to calculate an fuel injector driving period $T_I$ in Step 302 by using an expression: $T_I = K_C \times AN + T_D$. Then, in Step 303, the timer 38 is set for the calculated fuel injector driving period $T_I$, and then the timer 38 is triggered in Step 304 to drive the fuel injectors 29.

Referring to FIG. 4 showing an interrupt subroutine to be executed when the timer 36 applies an interrupt request signal to the interrupt input terminal $P_5$ of the microcomputer 31, the AD converter 33 converts a throttle position signal provided by the throttle position sensor 26 in Step 401 to give throttle position data $V_{74\,n}$ through the input terminal $P_2$ to the microcomputer 31. Then, in Step 402, throttle position data $V_{\theta O}$ obtained in the preceding cycle of the interrupt subroutine is read from the RAM 31B, the difference $V_{\theta O} - V_{\theta n}$ is calculated, and the the difference is compared with a predetermined value $\alpha$. When the difference is not less than the predetermined value $\alpha$, it is decided that the engine 20 is in a rapid deceleration mode, and then a passband fixing control signal is given to the AFS 27 in Step 403.

After Step 403 has been accomplished or when it is decided in Step 402 that the difference is smaller than the predetermined $\alpha$, Step 404 is executed to replace the previous throttle position data $V_{\theta O}$ with the present throttle position data $V_{\theta n}$ to update the file, and then the microcomputer 31 resumes the main routine.

The operation of the AFS 27 when the passband fixing control signal is provided by the microcomputer 31 will be described with reference to FIG. 5, in which the operation for controlling the first variable-frequency filter 12 and the second variable-frequency filter 13 is the same as that of the AFS of the conventional fuel supply control system described hereinbefore, and hence the description thereof will be omitted and only the characteristic operation of the AFS 27 will be described.

Figure 6:
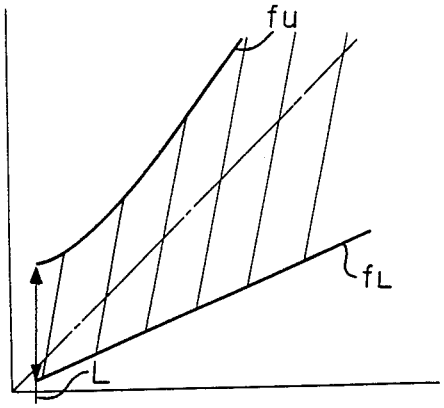
FIG. 6 is a graph showing the variation of the passbands of the variable-frequency filters of the AFS with the output frequency of the AFS.

Usually, problems arise only in the rapid deceleration mode. Therefore, the successive throttle position signals representing positions of the throttle valve 25 obtained by periodically sampling the throttle position signals provided by the throttle position sensor 26 are compared to decide on the basis of the difference between the successive throttle position signals if the engine 20 is in the rapid deceleration mode by the microcomputer 31. When the engine 20 is not in the rapid deceleration mode, the passband of the AFS 27 is not fixed. When the engine 20 is in the rapid deceleration mode, the microcomputer 31 applies a passband fixing control signal to the AFS 27. Then, the gate circuit 16 clips the output voltage of the f-V converter 15 and fixes the passband of the second variable-frequency filter 13 at a low frequency passband L as shown in FIG. 6 to remove the high frequency components of the input signal. Accordingly, even if a signal combined with high-frequency noises is applied to the first variable-frequency filter 12, the second variable-frequency filter 13 provides an output signal of a low frequency eliminating noises.

The gate circuit 16 may be by-passed depending on the throttle position in controlling the passband of the second variable-frequency filter 13.

Figure 7:
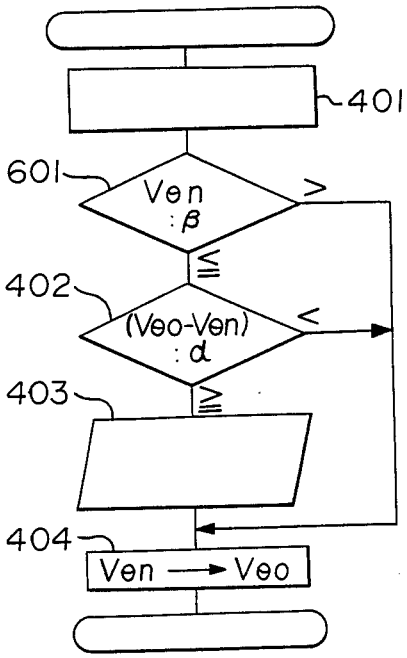
FIG. 7 is a flow chart showing a modification of a routine shown in FIG. 4.

An interrupt subroutine shown in FIG. 7 is a modification of the interrupt subroutine shown in FIG. 4. The interrupt subroutine shown in FIG. 7 has an additional Step 601 before the Step 402 of the interrupt subroutine shown in FIG. 4. In Step 601, the present throttle position data $V_{\theta n}$ is compared with a predetermined value $\beta$ corresponding to a small opening of the throttle valve 25. When $V_{\theta n} \leqq \beta$, it is decided that the throttle valve 25 is closed beyond a predetermined position, and then the present throttle position data $V_{\theta n}$ is compared with the preceding throttle position data $V_{\theta O}$. When $V_{\theta n} > \beta$, the routine jumps to Step 404, where the preceding throttle position data $V_{\theta O}$ is replaced with the present throttle position data $V_{\theta n}$ to update the file.

As is apparent from the foregoing description, the fuel control system in the first embodiment controls the fuel supply rate by fixing the passband of the second variable frequency filter 13 at the predetermined passband when the difference between the preceding and the present throttle position data is not less than the predetermined value. Accordingly, an accurate fuel control operation can be achieved avoiding the erroneous measurement of noises generated when the throttle valve 25 is closed as vortex frequency signals.

In this embodiment, the passband of the second variable-frequency filter 13 may be fixed at the predetermined passband when the opening of the throttle valve 25 is not more than a predetermined value. That is, upon the detection of the diminution of the opening of the throttle valve 25 detected by the throttle position sensor 26 below a predetermined opening, the microcomputer 31 applies a passband fixing control signal to the gate circuit 16 to fix the passband of the second variable-frequency filter 13 at a predetermined passband.

Figure 8:
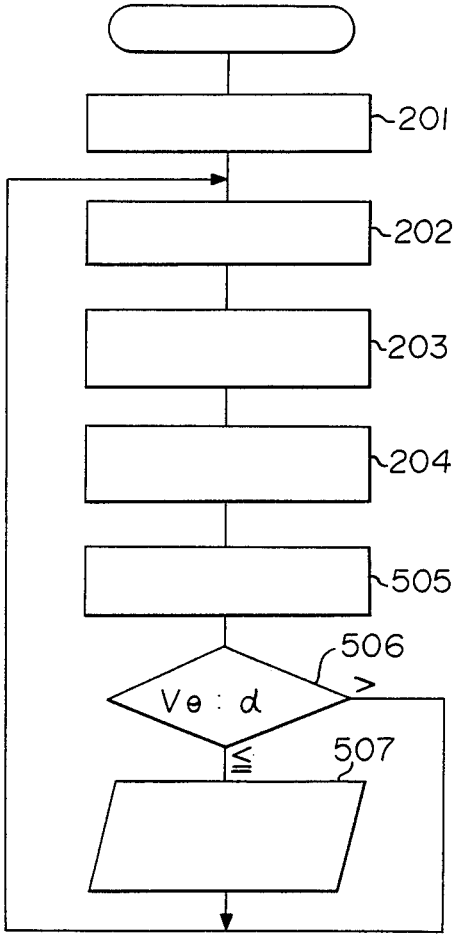
FIG. 8 is a flow chart of assistance in explaining a modification of the microcomputer of the fuel control system of FIG. 1.

Such a mode of operation of the microcomputer 31 will be described with reference to FIG. 8, in which functions like or corresponding to those previously described with reference to FIG. 2 are denoted by the same reference numerals.

Referring to FIG. 1 showing a main routine to be executed by the microcomputer 31, a reset signal is applied to the microcomputer 31 in Step 201 to initialize the RAM 31B and the input and output ports of the microcomputer 31. Then, in Step 202, the output voltage $V_B$ of the battery is converted into a corresponding digital voltage signal VB by the AD converter 37, and then the digital voltage signal VB is stored in the RAM 31B of the microcomputer 31. In Step 203, a dead time $T_D$ corresponding to the digital voltage data VB is obtained by mapping the data table $f_1$ stored beforehand in the ROM 31A, and then the dead time $T_D$ is stored in the RAM 13B. Then, in Step 204, the temperature of the engine cooling water is detected by a temperature sensor, not shown, for detecting the temperature of the engine cooling water, a correction coefficient $K_C$ for correcting the fuel supply rate is calculated on the basis of the temperature of the engine cooling water, and then the correction coefficient $K_C$ is stored in the RAM 31B. In Step 505, the AD converter 33 converts a throttle position signal provided by the throttle position sensor 26 into a digital throttle position data $V_\theta$, which in turn is applied to the input terminal $P_2$. Then, in Step 506, the digital throttle position data $V_\theta$ is compared with a reference value $\alpha$ corresponding to a predetermined throttle position, and then the routine returns to Step 202 when $V_\theta > \alpha$ or the routine goes to Step 507 when $V_\theta \leqq \alpha$. In Step 507, a passband fixing control signal is given to the AFS 27, and then the routine returns to Step 202. Thus, the main routine is repeated.

Since the passband of the second variable frequency filter 13 is thus fixed at a predetermined passband when the opening of the throttle valve 25 is not greater than a predetermined value, the erroneous measurement of noises generated while the throttle valve is shut as a vortex frequency signal is eliminated, so that a highly accurate fuel supply control operation can be achieved.

Second Embodiment (FIGS. 9 to 4):

A fuel control system in a second embodiment is substantially the same in constitution as that in the first embodiment shown in FIG. 1 and is different from that in the first embodiment in functions of the microcomputer 31, particularly, in timer interrupt subroutine, and hence only the timer interrupt subroutine will be described with reference FIG. 9 to avoid duplication.

Figure 9:
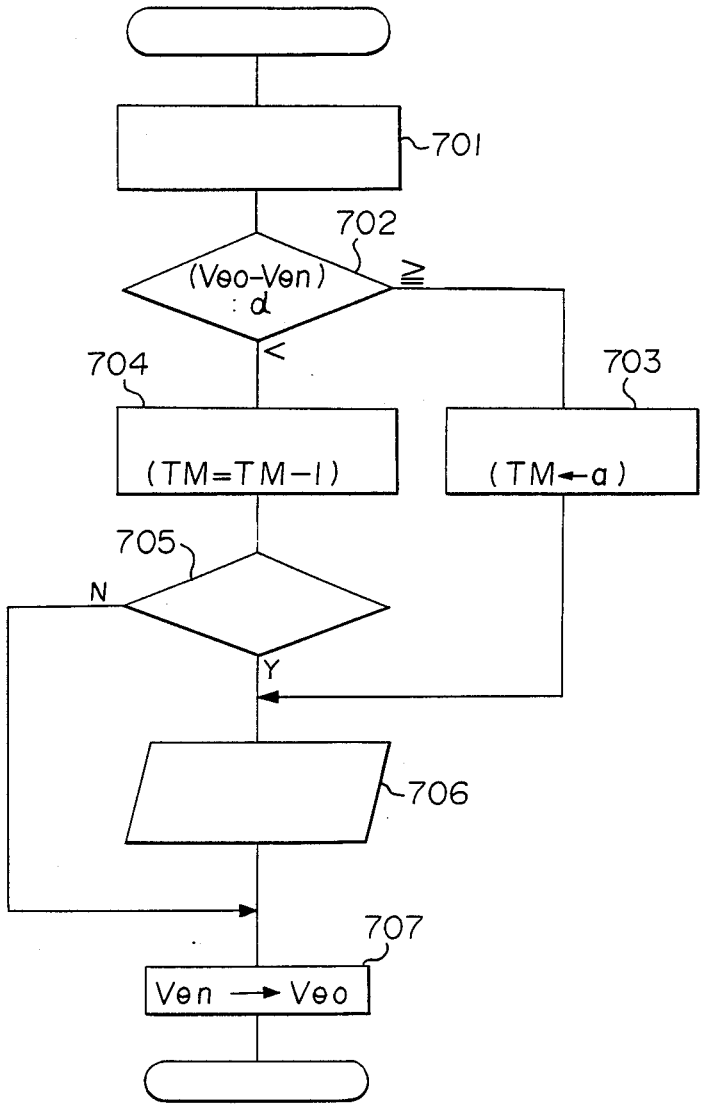
FIG. 9 is a flow chart of assistance in explaining the operation of a microcomputer incorporated into a fuel control system in a second embodiment according to the present invention.

The timer interrupt subroutine shown in FIG. 9 is executed when the timer 36 applies an interrupt signal to the interrupt input terminal $P_5$ of the microcomputer 31. In Step 701, the AD converter 33 converts a throttle position signal provided by the throttle position sensor 26 into a corresponding digital throttle position data $V_{\theta n}$ and applies the same to the input terminal $P_2$ of the microcomputer 31. Then, in Step 702, the microcomputer reads the preceding digital throttle position data $V_{\theta O}$ from the RAM 31B, calculates the difference $V_{\theta O} - V_{\theta n}$, and compares the difference with a predetermined value $\alpha$. Step 703 is executed to set a timer TM for a predetermined value a when $V_{\theta O} - V_{\theta n} \geqq \alpha$. When $V_{\theta O} - V_{\theta n} < \alpha$, it is decided that the engine is not in the predetermined deceleration mode and the timer TM is started in Step 704. Then, in Step 705, a decision is made whether or not a preset time interval for which the timer TM was set has elapsed. When the decision in Step 705 is negative or when Step 703 is executed, a passband fixing control signal $S_B$ is given to the AFS 27 in Step 706. When the decision in Step 705 is negative or when Step 706 is executed, the preceding digital throttle position data $V_{\theta O}$ is replaced with the present digital throttle position data $v_{\theta n}$ in Step 707, and then the microcomputer 31 resumes the main routine.

The timer TM may be a software usable on the microcomputer 31 or an external timer.

Figure 10:
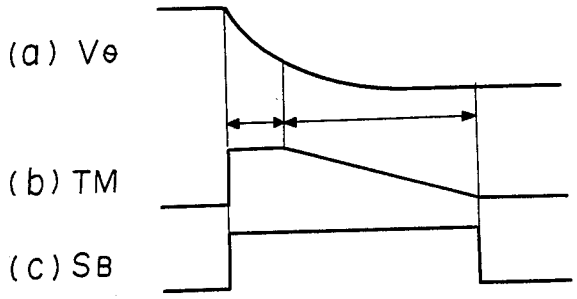
FIGS. 10(*a–c*) show a time chart showing signals used in the routine shown in FIG. 9.

FIG. 10 shows signals used in the interrupt subroutine of FIG. 9 in an exemplary mode of operation of the engine 20. In FIG. 10, (a) is the variation of the digital throttle position data $V_\theta$, (b) is the variation of the preset time interval for which the timer TM is set, and (c) is the passband fixing control signal $S_B$. As shown in FIG. 10, during the predetermined deceleration mode and during the predetermined time interval after the end of the predetermined deceleration mode, the passband fixing control signal $S_B$ remains HIGH.

The operation of the AFS 27 when the passband fixing control signal $S_B$ is provided by the microcomputer 31 will be described hereinafter with reference to FIG. 1 used in the description of the first embodiment. The passbands of the first variable-frequency filter 12 and the second variable-frequency filter 13 are controlled in the same manner as that employed in the first embodiment, and hence only the features of the AFS 27 will be described hereinafter.

Since problems arise only in the rapid deceleration mode (predetermined deceleration mode), the microcomputer 31 gives a passband fixing control signal $S_B$ to the gate circuit 16 in the predetermined deceleration mode, in which the variation of the digital throttle position data corresponding to the throttle positions signals generated by the throttle position sensor 26 is greater than a predetermined value, and during a time interval for which the timer TM is set subsequent to the predetermined deceleration mode. Upon the reception of the passband fixing control signal $S_B$ from the microcomputer 31, the gate circuit 16 clips the output voltage of the f-V converter 15 to fix the passband of the second variable-frequency filter 13 at a low frequency passband L as shown in FIG. 6, whereby the high-frequency components of the input signal is removed. Accordingly, even if a signal combined with high-frequency noises is applied to the first variable-frequency filter 12, the second variable-frequency filter 13 provides only an output signal of a low frequency eliminating noises.

The gate circuit 16 may be by-passed depending on the throttle position on controlling the passband of the second variable frequency filter 13.

Figure 11:
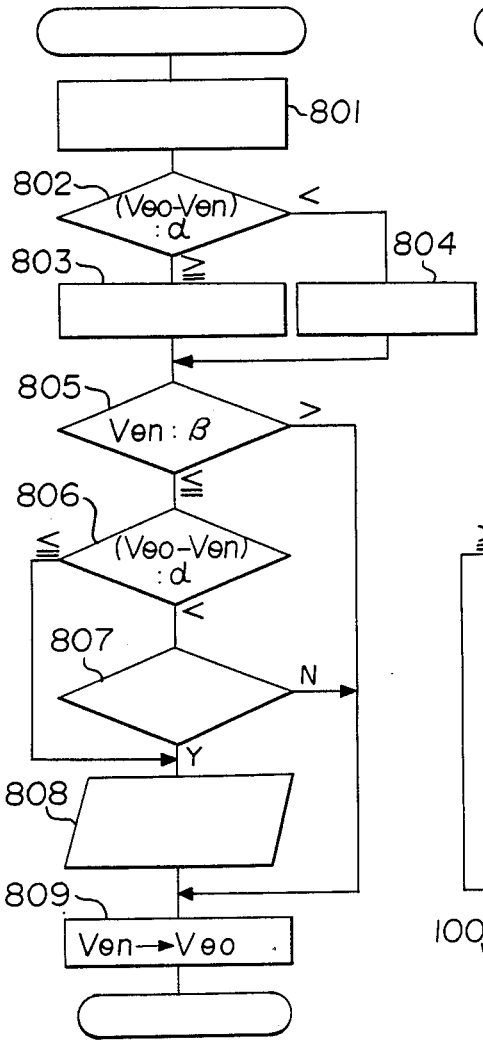
FIG. 11 is a flow chart of a modification of the timer interrupt routine of FIG. 9.

FIG. 11 shows a modification of the interrupt subroutine of FIG. 9, in which Steps 801 to 803 and Steps 801 to 804 are the same as Steps 701 to 703 and Steps 701 to 704 shown in FIG. 9, and hence the description of those Steps will be omitted to avoid duplication.

Step 805 is executed after the timer TM has been set for the predetermined value a in Step 803 or after the time interval for which the timer TM was has elapsed. In Step 805, the digital throttle position data $V_{\theta n}$ is compared with the predetermined value $\beta$. The routine jumps to Step 809 when $V_{\theta n}>\beta$. When $V_{\theta n}\leqq\beta$, namely, when the opening of the throttle valve 25 is smaller than a predetermined value, the difference between the successive digital throttle position data, i.e., $V_{\theta O}-V_{\theta n}$, is compared with the predetermined value $\alpha$ in Step 806. When $V_{\theta O}-V_{\theta n}\geqq\alpha$, namely, when the engine 20 is in the predetermined deceleration mode, Step 808 is executed. When $V_{\theta O}-V_{\theta n}<\alpha$, a decision is made in Step 807 to see if the timer TM is in operation. The routine jumps to Step 809 when the decision in Step 807 is negative, and the routine goes to Step 808 when the decision in Step 807 is affirmative.

In Step 808, microcomputer 31 provides the passband fixing control signal $S_B$. In Step 809 the preceding digital throttle position data $V_{\theta O}$ is replaced with the present digital throttle position data $V_{\theta n}$ to update the file. Then, the microcomputre 31 resumes the main routine shown in FIG. 2.

Figure 12:
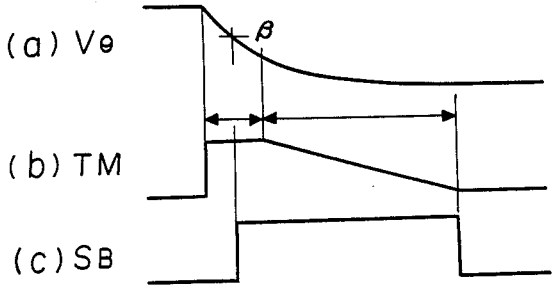
FIGS. 12(*a–c*) show a time chart showing signals used in the fuel control system in the second embodiment.

In this embodiment, the passband fixing control signal $S_B$ is generated when the engine 20 is in the predetermined deceleration mode and the digital throttle position data $V_{\theta n}\leqq\beta$, (when the opening of the throttle valve 25 is the predetermined value or below), the timer TM is actuated after the end of the predetermined deceleration mode, and the passband fixing control signal $S_B$ remains HIGH while the timer TM is in operation as shown in FIG. 12.

Figure 13:
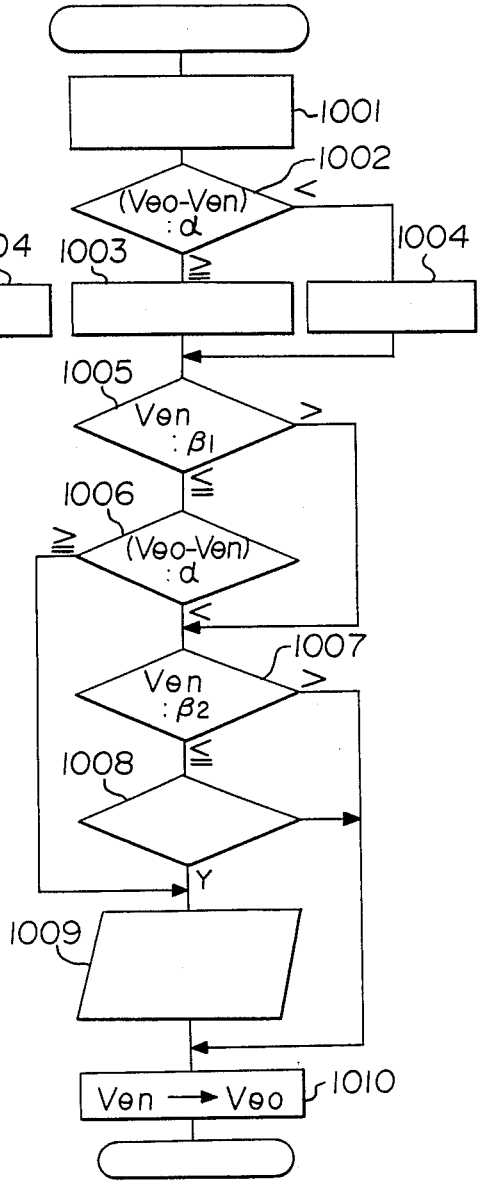
FIG. 13 is a flow chart of a further modification of the timer interrupt routine of FIG. 9.

FIG. 13 shows a further modification of the interrupt subroutine shown in FIG. 9, in which Steps 1001 to 1005 are the same as Steps 801 to 805 of the interrupt subroutine shown in FIG. 11, and hence the description thereof will be omitted to avoid duplication.

In Step 1005, a decision is made if the digital throttle position data $V_{\theta n}$ is greater than a first predetermined value $\beta_1$. The routine goes to Step 1007 when the decision in Step 1005 is affirmative. The routine goes to Step 1006 when $V_{\theta n}\leqq\beta_1$. In Step 1006, $V_{\theta O}-V_{\theta n}$ is compared with the predetermined value $\alpha$to decide if the engine 20 is in the predetermined deceleration mode. The routine jumps to Step 1009 when the decision in Step 1006 is affirmative. When the decision in Step 1006 is negative, the digital throttle position data $V_{\theta n}$ is compared with a second predetermined value $\beta_2$ ($\beta_1>\beta_2$) in Step 1007. The routine jumps to Step 1010 when $V_{\theta n}>\beta_2$. When $V_{\theta n}\leqq\beta_2$, a decision is made in Step 1008 if the timer TM is in operation. The routine jumps to Step 1010 when the decision in Step 1008 is negative. The routine goes to Step 1009 when the decision in Step 1008 is affirmative. In Step 1009, the passband fixing control signal $S_B$ is generated, and then the preceding digital throttle position data $V_{\theta O}$ is replaced with the present digital throttle position data $V_{\theta n}$ in Step 1010 to update the file.

Figure 14:
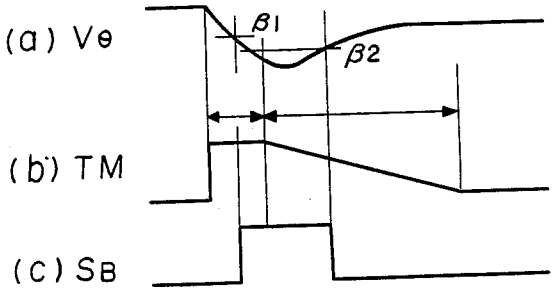
FIGS. 14(*a–c*) show a time chart showing signals used in the fuel control system in the second embodiment.

As shown in FIG. 14, in the interrupt subroutine shown in FIG. 13, the passband fixing control signal $S_B$ is generated when the engine is in the predetermined deceleration mode and the digital throttle position data $V_\theta$ is not more than the first predetermined value $\beta_1$ (the opening of the throttle valve 25 is not more than a predetermined first opening), and the passband fixing control signal $S_B$ is not generated even if the timer TM started immediately after the end of the predetermined deceleration mode is in operation, when the digital throttle position data $V_\theta$ is not more than the second predetermined value $\beta$.

As is apparent from the foregoing description, the fuel control system in accordance with the present invention controls fuel supply rate by fixing the passband of the variable-frequency filter at a predetermined passband while the engine is in the predetermined deceleration mode, in which the digital throttle position data representing the opening of the throttle valve diminishes rapidly, or during a time interval subsequent to the predetermined deceleration mode. Accordingly, the erroneous measurement of noises generated in closing the throttle valve as effective vortex frequencies is eliminated, so that highly accurate fuel control operation can be achieved.

Furthermore, since the fuel supply rate is controlled by fixing the passband of the variable-frequency filter at a predetermined passband when the engine is in the predetermined deceleration mode and the opening of the throttle valve is not more than a predetermined first opening, and only while the opening of the throttle valve is not more than a predetermined second opening in a predetermined time interval subsequent to the deceleration mode, the erroneous measurement of noises generated when the opening of the throttle valve is not more than the first predetermined opening as effective vortex frequencies is avoided, and the passband of the variable frequency filter is not fixed when the operating mode is changed from the predetermined deceleration mode into an acceleration mode during the time interval subsequent to the predetermined deceleration mode, so that an accurate fuel supply control can be achieved according to the operating condition of the engine.

What is claimed is:

1. A fuel control system for controlling fuel supply rate for an internal combustion engine on the basis of the output signal of a vortex flowmeter including signal detecting means for detecting a vortex signal corresponding to an intake air flow in the engine, and variable-frequency filter means which passes the output signal of the signal detecting means, having variable frequency bands corresponding to the frequencies of the output signals of the signal detecting means to eliminate noise signals superposed on the vortex signal, comprising:

operating mode detecting means for detecting the operating mode of the engine and generating an output signal, said mode comprising the opening of a throttle; and passband fixing means for fixing the passband of the variable-frequency filter means at a predetermined passband in accordance with the output signal of the operating mode detecting means, when the opening of said throttle has a value less than a predetermined value.

2. A fuel control system according to claim 1, wherein said variable-frequency filter means includes a first variable-frequency filter means which passes the high-frequency components of the input signal and a second variable-frequency filter means which passes the low-frequency components of the input signal, and the second variable-frequency filter means is controlled by passband fixing means.

3. A fuel control system according to claim 1, wherein said operating mode detecting means detects the opening of the throttle valve of the engine provided in the suction pipe and generates a detection signal when the opening of the throttle valve is not more than a predetermined value.

4. The fuel control system of claim 1 wherein said operating mode detecting means comprises a throttle position sensor and said output signal comprises a position signal, and said passband fixing means is responsive to a comparison of at least two of said position signals taken at different times.

5. The fuel control system of claim 4 wherein said passband fixing means fixes said passband when said comparison yields a difference not less than a predetermined value.

6. The fuel control system of claim 4 wherein said passband fixing means stores a first position signal generated earlier in time for comparison with a second position signal generated later in time and wherein said stored first position signal is replaced with said second position signal when said comparison yields a difference that is smaller than a predetermined value.

7. A fuel control system for controlling fuel supply rate for an internal combustion engine on the basis of the output signal of a vortex flowmeter including signal detecting means for detecting a vortex signal corresponding to an intake air flow in the engine, and variable-frequency filter means for passing the output signal of the signal detecting means in a passband corresponding to the frequency of a feedback signal, comprising:

passband fixing means for fixing the passband of the variable-frequency filter means at a predetermined passband during a predetermined deceleration mode in which the decrement of the opening of the throttle valve is not less then a predetermined value and during a predetermined time interval subsequent to the predetermined deceleration mode.

8. A fuel control system according to claim 7, wherein said passband fixing means fixes the passband of said variable-frequency filter means when the opening of the throttle valve is not more than a predetermined first value in the predetermined deceleration mode, and when the opening of the throttle valve is not more than a predetermined second value in a predetermined time interval subsequent to the deceleration mode.

* * * * *